US006572522B1

(12) United States Patent
Shimer

(10) Patent No.: US 6,572,522 B1
(45) Date of Patent: Jun. 3, 2003

(54) JOGGER FOR CARTON BLANK PROCESSING AND METHOD

(76) Inventor: Raymond J. Shimer, 6610 Alley Rd., Summerfield, NC (US) 27358

( * ) Notice: Subject to any disclaimer, the term of this patent is extended or adjusted under 35 U.S.C. 154(b) by 149 days.

(21) Appl. No.: 09/587,327

(22) Filed: Jun. 5, 2000

(51) Int. Cl.[7] ..... B31B 49/00

(52) U.S. Cl. ..... 493/468; 493/480; 493/412; 493/114

(58) Field of Search ..... 493/114, 394, 493/412, 468, 480

(56) References Cited

U.S. PATENT DOCUMENTS 2,358,062 A * 9/1944 Farkas
2,900,882 A * 8/1959 Theobald
5,308,305 A * 5/1994 Romney
5,484,380 A * 1/1996 Bevins ..... 493/480
5,529,565 A * 6/1996 Oetlinger ..... 493/468
5,599,269 A * 2/1997 Oetlinger ..... 493/468
5,647,601 A * 7/1997 Potter et al.

OTHER PUBLICATIONS

Bobst Instruction—Autoplatine– ER, Separation des poses Blanking Nutzentrennung 050000 3001 0702, Fabrication des outils Tool manufacturing Werkeugherstellung, ©1989.

* cited by examiner

*Primary Examiner*—Eugene Kim
*Assistant Examiner*—Sameh Tawfik

(57) ABSTRACT

A jogger as used with carton blank forming equipment is provided having a slide with first and second shoulders for engaging a threaded dog contained within the side rail of the jogger body. The slide also includes a back channel which allows the slide to pass over the mounting bolt contained within a body race aperture.

9 Claims, 4 Drawing Sheets

JOGGER FOR CARTON BLANK PROCESSING AND METHOD

FIELD OF THE INVENTION

The invention herein pertains to equipment used in the manufacture of paper carton blanks and particularly pertains to joggers which assist in the manipulation and handling of carton blanks.

DESCRIPTION OF THE PRIOR ART AND OBJECTIVES OF THE INVENTION

The majority of products which are displayed in retail and other stores are delivered in paper or cardboard boxes of various shapes and dimensions. Industrial carton manufacturing equipment is commercially available which accepts, for example, cardboard sheets from a feed table which are then fed to a steel rule die section which cuts, embosses and/or scores the cardboard sheets. The cut sheets are then further processed as by stripping out the unnecessary components, resulting in a carton blank. The carton blanks are then stacked. These manufacturing steps are carried out at rapid speeds and stacks of carton blanks produced in only seconds are then conveyed, usually on reusable wooden pallets to a storage area where they are bound or wrapped for transportation to the customer. Upon arrival, the blanks are folded into boxes and filled with desired merchandise.

During the carton blank manufacturing process, as the stacks of blanks are being handled after cutting or scoring, they are stacked to a predetermined height and are usually wrapped before shipping to maintain the integrity of the stacks. Also, insert sheets are placed in the stacks at specific intervals to ensure the stability of the stacks. As the stacks reach a predetermined height, electronic controls cause the stacks to be lowered a few millimeters to allow for positioning of the insert sheets. As the stacks are relatively unstable during this step, joggers positioned around the periphery of the stacks maintain pressure on the stacks as they are being lowered. The slight pressure afforded by the joggers ensures the carton blank stacks remain even and stable. When completed, the stacks are then moved, usually by conveyor to another area where they are bound for storage and shipment.

The equipment used in forming carton blanks provides frames which support the joggers and are sized to approximate the carton blank dimensions. The number of frames and joggers used is dependent on the particular size and shape of the carton blanks being stacked. It is not unusual for 6–8 stacks of carton blanks to be processed simultaneously onto a single pallet. It is important that each stack remain aligned and spaced from the other stacks on the pallet since the automated high speed equipment which folds, fills and further processes the carton blanks into cartons accepts only properly aligned blanks and often jams if the blank stacks are askew.

Conventional joggers are affixed by various arrangements to the stacking frames employed but all joggers consist of a main body and a slide which moves in a vertical direction within the body. The slide is designed to move a few millimeters, usually less than twenty-five, whereby movement is terminated by a mounting bolt head positioned against the body race. While such length of slide movement is oftentimes adequate, in certain carton blank manufacture such length of slide movement is inadequate. Also, dust and debris can collect around the mounting bolt head causing problems with the slide movement, sometimes accumulating to shorten further the slide movement length.

Thus, in view of the problems and disadvantages of conventional joggers, the present invention was conceived and one of its objectives is to provide a jogger having extended slide movement length while eliminating the mounting bolt head stop.

It is still another objective of the present invention to provide a jogger slide with opposing shoulders which act to limit the slide's movement.

It is a further objective of the current invention to provide a stop member in the form of a dog which is threadably inserted into a side rail of the jogger body.

It is a further objective of the present invention to provide a jogger slide which defines a channel in its back surface to avoid the mounting bolt head.

Various other objectives and advantages of the present invention will become apparent to those skilled in the art as a more detailed description is set forth below.

SUMMARY OF THE INVENTION

The aforesaid and other objectives are realized by providing a jogger for use in carton blank forming equipment which includes a metal body and slide. The metal body includes a race having a pair of opposing side rails. An aperture is defined within the race for receiving a mounting bolt. A channel in the slide back surface allows the slide to avoid the mounting bolt head as it moves along the race. Shoulders are formed in the slide which engage a threaded dog positioned in one of the side rails. The slide shoulders, upon engaging the dog prevent the slide from further movement.

The method describes the jogging of carton blanks utilizing the aforedescribed jogger by first making the same and then using the jogger in the same manner as standard joggers to provide carton blank stack stability.

DETAILED DESCRIPTION OF THE PREFERRED EMBODIMENT AND OPERATION OF THE INVENTION

Figure 1:
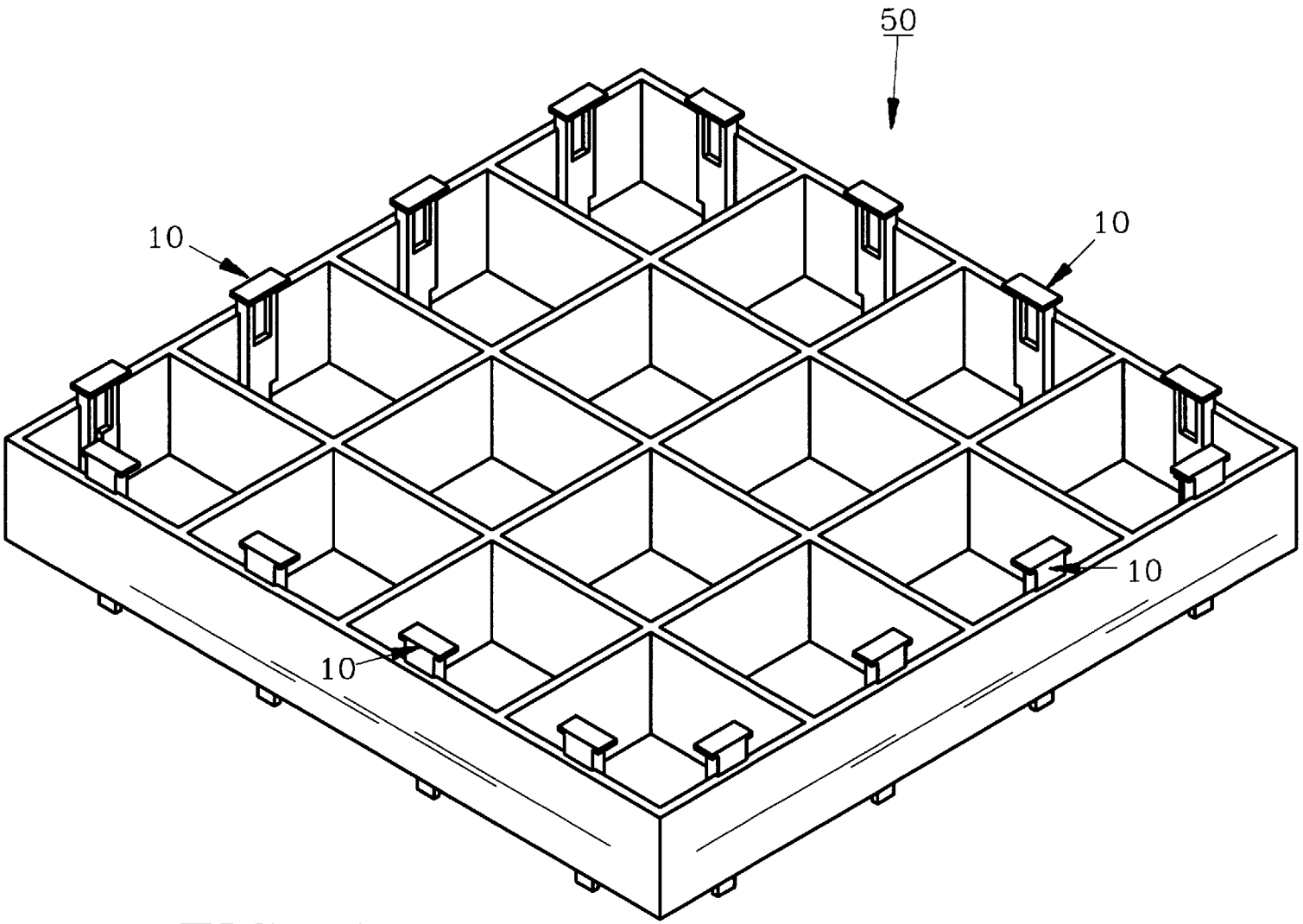
FIG. 1 shows a schematic perspective view of a grid which supports a series of joggers along the periphery thereof as used with carton blank stacks during manufacture.
Figure 2:
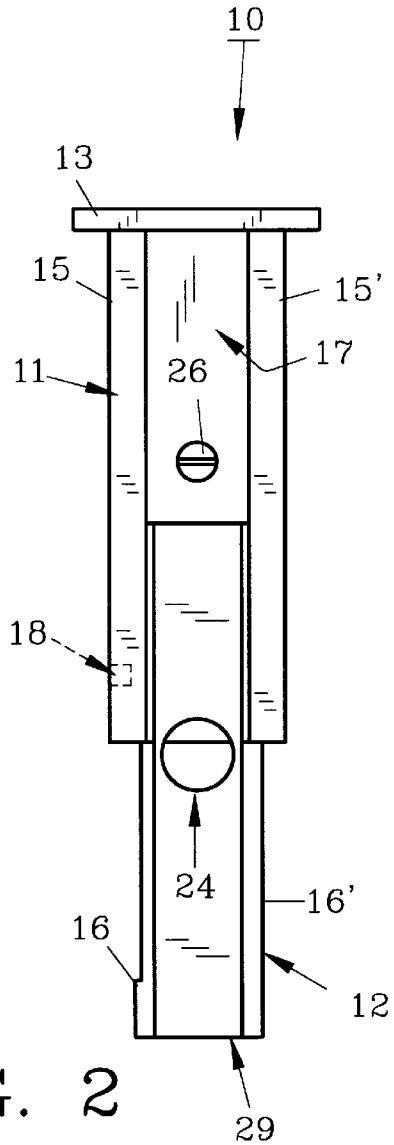
FIG. 2 illustrates a front view of the jogger of the invention with the slide partially extended from the body.

For a better understanding of the invention and its operation, turning now to the drawings, FIG. 2 illustrates a front view of preferred jogger 10 having a main body 11 containing slide 12. Body 11 and slide 12 are made from metal, preferably steel or other metals, alloys or even certain plastics may be used. Top 13 and mounting block 14 as shown in FIG. 7 provide means for attaching jogger 10 to particular frames, such as frame 50 as seen in FIG. 1, although other mounting structures may be used for specific carton blank equipment and particular carton blanks.

Figure 4:
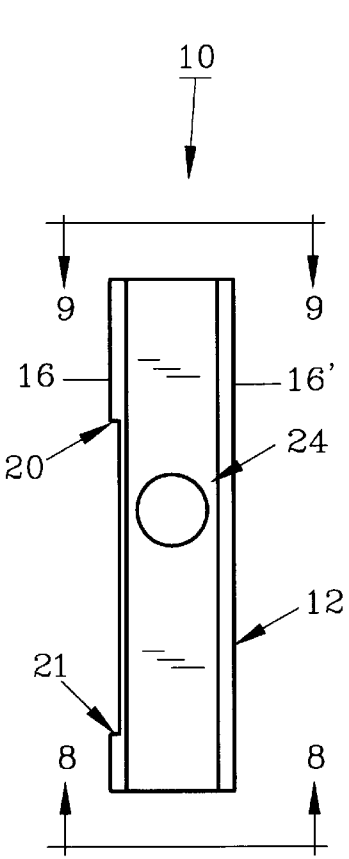
FIG. 4 pictures a front view of the slide as removed from the body.
Figure 3:
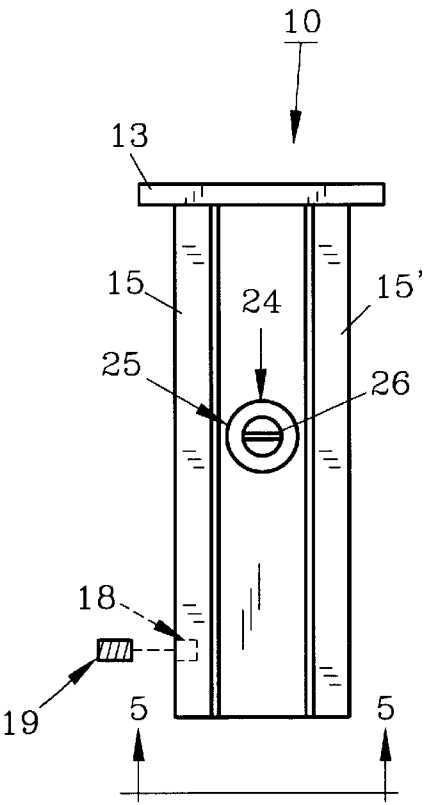
FIG. 3 depicts a front view of the jogger as seen in FIG. 2 with the threaded dog removed therefrom and with the slide in a fully retracted posture.
Figure 8:
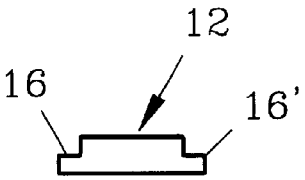
FIG. 8 denotes an end view of the slide as seen in FIG. 4 along lines 8—8.
Figure 9:
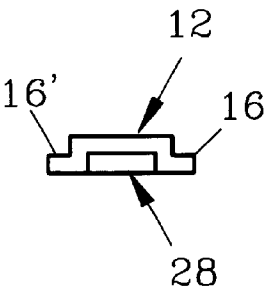
FIG. 9 demonstrates an end view of the slide along lines 9—9 as seen in FIG. 4.
Figure 5:
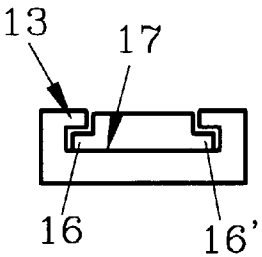
FIG. 5 demonstrates an end view of the slide of the jogger as shown in FIG. 3 along line 5—5.
Figure 6:
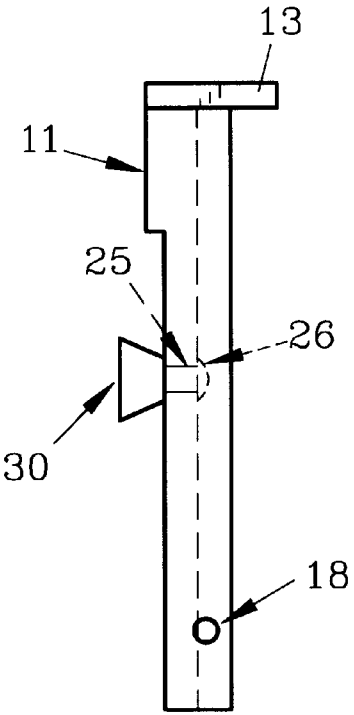
FIG. 6 shows a left side elevational view of the jogger as shown in FIG. 3.

Body 11 includes side rails 15, 15' as shown in FIGS. 2, 3 and 5 which engage edges 16, 16' of slide 12 as shown in FIGS. 8 and 9. Race 17 as seen in FIGS. 2 and 5 provides a surface for slide 12 to move therealong. As shown in FIGS. 4 and 7, slide 12 includes along one longitudinal edge 16, a first shoulder 20 and a second shoulder 21, which are opposingly positioned for alternately engaging dog 19 as seen in FIG. 3. Dog 19 is threaded for positioning in side rail aperture 18 as seen in FIG. 6. Thus, as slide 12 moves within body 11, dog 19 prevents slide 12 from extending excessively outwardly therefrom as first shoulder 20 engages dog 19. Likewise, dog 19 engages shoulder 21 of slide 12 to prevent excessive inwardly movement thereof.

Mounting bolt 25 seen in FIG. 3 in body 11 is visible through aperture 24 of slide 12. Bolt head 26 will not engage slide 12 as seen in FIGS. 3 and 6 as slide 12 includes channel 28 on the back thereof also shown in FIG. 7, which allows slide 12 to pass thereover.

Figure 7:
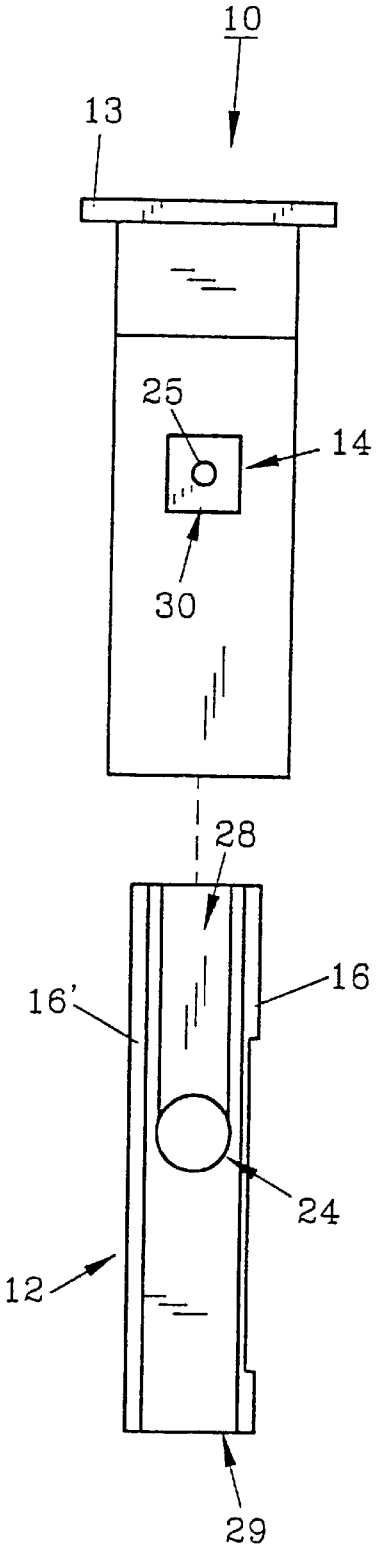
FIG. 7 illustrates the jogger of FIG. 2 as seen from the back with the slide completely removed from the body.

As shown in FIGS. 6 and 7, mounting bolt 25 extends through race 17 and threadably connects to mounting block 30. Various other types of mountings, other than with mounting block 30 are available for particular frames and other mountings are currently used for attaching joggers to various frames in commercial manufacturing.

Figure 10:
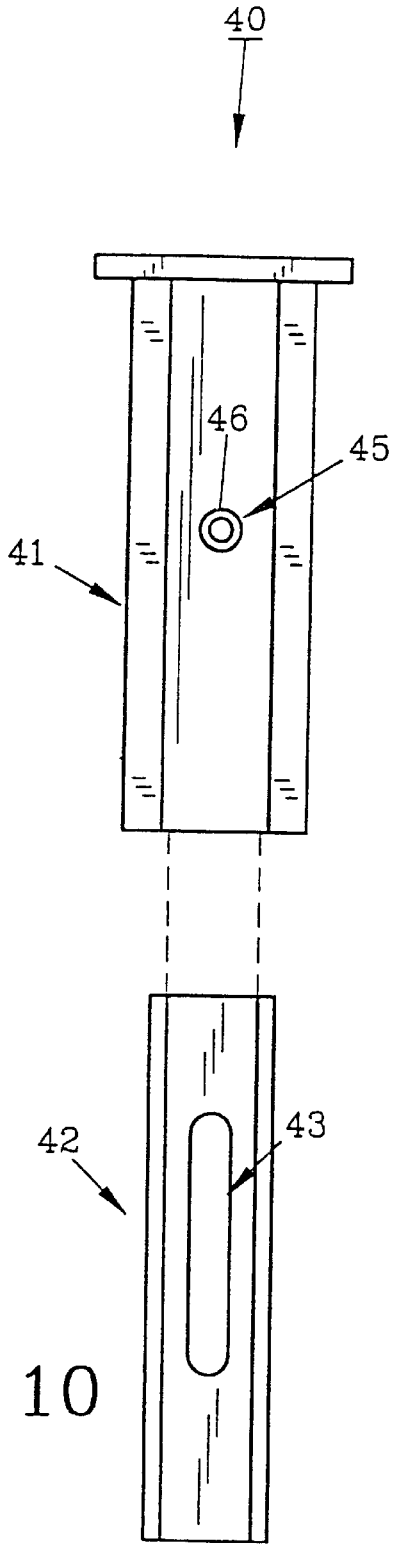
FIG. 10 (PRIOR ART)
FIG. 10 illustrates a front view of a prior art jogger with the slide removed therefrom.

Prior art jogger 40 as shown in FIG. 10 provides jogger body 41 with slide 42. Slide 42 includes a central slot 43 which engages mounting bolt head 46 and as would be understood, slide 42 moves within body 41, only limited by the length of slot 43 as it engages mounting bolt 45 at the extents of its movement. As slot 43 and mounting bolt 45 are constantly exposed, dust and debris can cause jamming and can limit the movement of slide 42.

The preferred method of jogging carton blanks with jogger 10 herein comprises the steps of forming a jogger such as jogger 10 having body 11 and slide 12 and thereafter contacting a carton blank with terminal end 29 of jogger slide 12 as shown in FIGS. 2 and 7. Next, the carton blanks (not seen) are moved in a downward direction while allowing slide 12 to move downwardly to follow the same. The downward movement of slide 12 is terminated as first shoulder 20 contacts dog 19 as seen in FIG. 3. An insert sheet is then placed on the carton blanks causing slide 12 to move upwardly. Such upward movement of slide 12 terminates as shoulder 21 engages dog 19 as slide 12 passes over mounting bolt head 26.

The illustrations and examples provided herein are for explanatory purposes and are not intended to limit the scope of the appended claims.

I claim:

1. A jogger comprising a body, a slide, said slide contained within said body, a dog, said dog contained within said body, said slide defining a first and a second shoulder along an edge thereof, said first shoulder contacting said dog for limiting the movement of said slide from said body and said second shoulder for limiting the movement of said slide into said body, a dog, said dog attached to said body for engagement with said shoulders.

2. The jogger of claim 1 wherein said dog comprises a threaded member.

3. The jogger of claim 1 further comprises a mounting block, said mounting block attached to said body.

4. The jogger of claim 3 further comprising a mounting bolt, said mounting bolt comprising a head, said slide defining a channel, said channel allowing said slide to avoid said bolt head during movement with said body.

5. The jogger of claim 1 wherein said body defines a side rail aperture, said side rail aperture for receiving said dog.

6. A jogger comprising a body, a slide, said slide contained within said body, said slide defining a first shoulder along an edge thereof, said body defining a side aperture, a dog, said dog adjustably positioned in said side aperture proximate said shoulder whereby said shoulder will contact said dog to terminate movement of said slide in said body.

7. The jogger of claim 6, wherein said slide defines a back channel.

8. The jogger of claim 7, further comprising a mounting bolt, said mounting bolt positioned in said body, said back channel configured to allow said slide to move within said body while avoiding said mounting bolt.

9. The jogger of claim 6, wherein said slide defines a second shoulder, said second shoulder positioned along an edge of said slide in opposition to said first shoulder, said dog between said first and said second shoulder to limit the movement of said slide as said shoulders contact said dog.

* * * * *